US008181480B2

(12) United States Patent
Kasahara et al.

(10) Patent No.: US 8,181,480 B2
(45) Date of Patent: May 22, 2012

(54) REFRIGERATION DEVICE

(75) Inventors: Shinichi Kasahara, Sakai (JP); Toshiyuki Kurihara, Sakai (JP); Shuuji Fujimoto, Sakai (JP); Takahiro Yamaguchi, Sakai (JP); Atsushi Yoshimi, Sakai (JP); Yoshio Ueno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 603 days.

(21) Appl. No.: 12/440,045

(22) PCT Filed: Sep. 7, 2007

(86) PCT No.: PCT/JP2007/067470

§ 371 (c)(1),
(2), (4) Date: Mar. 5, 2009

(87) PCT Pub. No.: WO2008/032645

PCT Pub. Date: Mar. 20, 2008

(65) Prior Publication Data

US 2010/0180612 A1 Jul. 22, 2010

(30) Foreign Application Priority Data

Sep. 11, 2006 (JP) ..... 2006-246155
Mar. 2, 2007 (JP) ..... 2007-053351

(51) Int. Cl.
*F25B 1/00* (2006.01)
*F25B 41/00* (2006.01)
*F25B 41/04* (2006.01)

(52) U.S. Cl. ..... 62/498; 62/513; 62/205

(58) Field of Classification Search ..... 62/225, 62/498, 513, 434, 190, 205, 210, 222, 509, 62/197, 198

See application file for complete search history.

(56) References Cited

U.S. PATENT DOCUMENTS

2006/0080989 A1* 4/2006 Aoki et al. ..... 62/324.4
2009/0013700 A1* 1/2009 Unezaki et al. ..... 62/77

FOREIGN PATENT DOCUMENTS

JP 08-005185 A 1/1996
JP 08005185 A * 1/1996
JP 10-115470 A 5/1998
JP 11-063686 A 3/1999

(Continued)

OTHER PUBLICATIONS

Chinese Office Action of corresponding Chinese Application No. 200780033412.3, dated Nov. 27, 2009.

(Continued)

*Primary Examiner* — Chen Wen Jiang
(74) *Attorney, Agent, or Firm* — Global IP Counselors

(57) ABSTRACT

A refrigeration device includes a compression mechanism, a radiator, a first expansion mechanism, a second expansion mechanism, an evaporator, a first internal heat exchanger, a branch pipe a third expansion mechanism, and a second internal heat exchanger. The first internal heat exchanger causes heat to be exchanged between refrigerant that flows from the radiator to the inflow side of the first expansion mechanism, and refrigerant that flows from the evaporator to the compression mechanism. The branch pipe branches from a third refrigerant pipe for connecting the radiator and the second expansion mechanism, and merges with the second refrigerant pipe. A third expansion mechanism is provided to the branch pipe. The second internal heat exchanger causes heat to be exchanged between refrigerant that flows out from the first expansion mechanism, and refrigerant that flows out from the third expansion mechanism.

14 Claims, 8 Drawing Sheets

FOREIGN PATENT DOCUMENTS

| | | | | |
|---|---|---|---|---|
| JP | 11-142007 | A | | 5/1999 |
| JP | 2001-004235 | A | | 1/2001 |
| JP | 2001-066003 | A | | 3/2001 |
| JP | 2002-106985 | A | | 4/2002 |
| JP | 2002-156161 | A | | 5/2002 |
| JP | 2002-228275 | A | | 8/2002 |
| JP | 2002-228282 | A | | 8/2002 |
| JP | 2003-83620 | A | | 3/2003 |
| JP | 2004-251574 | A | | 9/2004 |
| JP | 2005-214443 | A | | 8/2005 |
| JP | 2005214443 | A | * | 8/2005 |
| JP | 2006-153349 | A | | 6/2006 |
| JP | 2006153349 | A | * | 6/2006 |

OTHER PUBLICATIONS

Japanese Office Action of corresponding Japanese Application No. 2007-053351 dated Sep. 13, 2011.

* cited by examiner

REFRIGERATION DEVICE

CROSS-REFERENCE TO RELATED APPLICATIONS

This U.S. National stage application claims priority under 35 U.S.C. §119(a) to Japanese Patent Application Nos. 2006-246155 and 2007-053351, filed in Japan on Sep. 11, 2006, Mar. 2, 2007, respectively, the entire contents of which are hereby incorporated herein by reference.

TECHNICAL FIELD

The present invention relates to a refrigeration device, and particularly relates to a refrigeration device in which the refrigerant attains a supercritical state during the refrigeration cycle.

BACKGROUND ART

Conventional refrigeration devices are widely known that are provided with a refrigerant circuit in which a compressor; a radiator configured to release heat from the refrigerant discharged from the compressor; a first expansion valve configured to reduce the pressure of the refrigerant that flows out from the radiator; a liquid receiver configured to store a portion of the refrigerant that flows out from the first expansion valve; a second expansion valve configured to reduce the pressure of the refrigerant that flows out from the liquid receiver; an evaporator configured to evaporate the refrigerant that flow out from the second expansion valve; and an internal heat exchanger for exchanging heat between the refrigerant that flows in a refrigerant pipe for connecting the exit side of the radiator and the refrigerant inflow side of the first expansion valve, and the refrigerant that flows in a refrigerant pipe for connecting the exit side of the evaporator and the refrigerant intake side of the compressor, are connected in sequence (see Japanese Laid-open Patent Application No. 2002-228282 (FIG. 10), for example).

SUMMARY OF THE INVENTION

Technical Problem

However, when an internal heat exchanger is merely provided to the refrigerant inflow side of the first expansion valve in the manner described above, not only is it difficult to impart an adequate degree of subcooling to the refrigerant that has passed through the first expansion valve, but there is also a risk of the refrigerant sucked into the compressor becoming overly superheated.

An object of the present invention is to make it possible to impart an adequate degree of subcooling to the refrigerant that has passed through the first expansion mechanism, and to maintain the proper degree of superheating of the refrigerant sucked into the compressor in a refrigeration device such as the one described above.

Solution to Problem

A refrigeration device according to a first aspect of the present invention comprises a compression mechanism, a radiator, a first expansion mechanism, a second expansion mechanism, an evaporator, a first internal heat exchanger, a branch pipe, a third expansion mechanism, and a second internal heat exchanger. The compression mechanism configured to compress a refrigerant. The radiator is connected to a refrigerant discharge side of the compression mechanism. The first expansion mechanism is connected to an exit side of the radiator. The second expansion mechanism is connected to a refrigerant outflow side of the first expansion mechanism. The evaporator is connected to a refrigerant outflow side of the second expansion mechanism, and to a refrigerant intake side the compression mechanism. The first internal heat exchanger causes heat to be exchanged between refrigerant that flows in a first refrigerant pipe for connecting the exit side of the radiator and an inflow side of the first expansion mechanism, and refrigerant that flows in a second refrigerant pipe for connecting the exit side of the evaporator and the refrigerant inflow side of the compression mechanism. The branch pipe branches from a third refrigerant pipe for connecting the exit side of the radiator and the refrigerant inflow side of the second expansion mechanism, and merges with the second refrigerant pipe. The third expansion mechanism is provided to the branch pipe. The second internal heat exchanger causes heat to be exchanged between refrigerant that flows out from the first expansion mechanism and refrigerant that flows out from the third expansion mechanism.

In this refrigeration device, the branch pipe that branches from a third refrigerant pipe for connecting the exit side of the radiator and the refrigerant inflow side of the second expansion mechanism merges with the second refrigerant pipe for connecting the exit side of the evaporator and the refrigerant inflow side of the compression mechanism, and the third expansion mechanism is provided to the branch pipe. The proper degree of superheating of the refrigerant sucked into the compression mechanism can therefore be maintained in this refrigeration device. In the second internal heat exchanger in this refrigeration device, heat is exchanged between the refrigerant that flows out from the first expansion mechanism and the refrigerant that flows out from the third expansion mechanism. It is therefore possible in this refrigeration device to impart an adequate degree of subcooling to the refrigerant that has passed through the first expansion mechanism.

A refrigeration device according to a second aspect of the present invention is the refrigeration device according to the first aspect of the present invention, wherein the branch pipe branches from a fourth refrigerant pipe for connecting the refrigerant outflow side of the first expansion mechanism and the refrigerant inflow side of the second expansion mechanism and merging with the second refrigerant pipe.

In this refrigeration device, the branch pipe that branches from the fourth refrigerant pipe for connecting the refrigerant outflow side of the first expansion mechanism and the refrigerant inflow side of the second expansion mechanism merges with the second refrigerant pipe for connecting the exit side of the evaporator and the refrigerant intake side of the compression mechanism, and the third expansion mechanism is provided to the branch pipe. A more adequate degree of subcooling can therefore be imparted to the refrigerant that has passed through the first expansion mechanism in this refrigeration device.

A refrigeration device according to a third aspect of the present invention is the refrigeration device according to the first or second aspect of the present invention, wherein the branch pipe merges with the second refrigerant pipe so that refrigerant that flows out from the third expansion mechanism and undergoes heat exchange in the second internal heat exchanger merges with refrigerant that flows through the second refrigerant pipe before the refrigerant flows into the first internal heat exchanger.

In this refrigeration device, the branch pipe merges with the second refrigerant pipe so that refrigerant that flows out from the third expansion mechanism and undergoes heat exchange in the second internal heat exchanger merges with refrigerant that flows through the second refrigerant pipe before the refrigerant flows into the first internal heat exchanger. The capability of the first internal heat exchanger can therefore be adjusted in this refrigeration device.

A refrigeration device according to a fourth aspect of the present invention is the refrigeration device according to the first or second aspect of the present invention, wherein the branch pipe merges with the second refrigerant pipe so that refrigerant that flows out from the third expansion mechanism and undergoes heat exchange in the second internal heat exchanger merges with refrigerant that flows through the second refrigerant pipe after the refrigerant has passed through the first internal heat exchanger.

In this refrigeration device, the branch pipe merges with the second refrigerant pipe so that refrigerant that flows out from the third expansion mechanism and undergoes heat exchange in the second internal heat exchanger merges with refrigerant that flows through the second refrigerant pipe after the refrigerant has passed through the first internal heat exchanger. The proper degree of superheating of the refrigerant sucked into the compression mechanism can therefore be maintained in this refrigeration device by merging the refrigerant placed in a damp state by the third expansion mechanism with the refrigerant sucked into the compression mechanism in a case in which the degree of superheating of the refrigerant sucked into the compression mechanism is extremely high, for example.

A refrigeration device according to a fifth aspect of the present invention is the refrigeration device according to the first or second aspects of the present invention, wherein the branch pipe merges with the second refrigerant pipe connected to an entry side of the first internal heat exchanger.

In this refrigeration device, the branch pipe merges with the second refrigerant pipe connected to the entry side of the first internal heat exchanger. The capability of the first internal heat exchanger can therefore be adjusted in this refrigeration device.

A refrigeration device according to a sixth aspect of the present invention is the refrigeration device according to the first or second aspects of the present invention, wherein the branch pipe merges with the second refrigerant pipe connected to an exit side of the first internal heat exchanger.

In this refrigeration device, the branch pipe merges with the second refrigerant pipe connected to the exit side of the first internal heat exchanger. The proper degree of superheating of the refrigerant sucked into the compression mechanism can therefore be maintained in this refrigeration device by merging the refrigerant placed in a damp state by the third expansion mechanism with the refrigerant sucked into the compression mechanism in a case in which the degree of superheating of the refrigerant sucked into the compression mechanism is extremely high, for example.

A refrigeration device according to a seventh aspect of the present invention is the refrigeration device according to any of the first through sixth aspects of the present invention, further comprising a first control unit. The first control unit controls the third expansion mechanism so that the degree of superheating of the refrigerant that flows to the refrigerant intake side of the compression mechanism from a merging point of the branch pipe and the second refrigerant pipe is within a predetermined range.

In this refrigeration device, the first control unit controls the third expansion mechanism so that the degree of superheating of the refrigerant that flows to the refrigerant intake side of the compression mechanism from a merging point of the branch pipe and the second refrigerant pipe is within a predetermined range. The proper degree of superheating of the refrigerant sucked into the compression mechanism can therefore be maintained in this refrigeration device.

A refrigeration device according to an eighth aspect of the present invention is the refrigeration device according to any of the first through seventh aspects of the present invention, further comprising a liquid receiver and a second control unit. The liquid receiver is provided between the refrigerant outflow side of the first expansion mechanism and an inflow port for refrigerant that flows through the first refrigerant pipe of the second internal heat exchanger. The second control unit performs refrigerant cooling control for cooling the refrigerant that flows through the first refrigerant pipe by the first internal heat exchanger so that the refrigerant that has flowed out from the first expansion mechanism does not reach a state near the critical point.

When the refrigerant is expanded by the first expansion mechanism to a state near the saturation line in a case in which the liquid receiver is thus provided between the refrigerant outflow side of the first expansion mechanism and an inflow port for refrigerant that flows through the first refrigerant pipe of the second internal heat exchanger, the refrigerant sometimes reaches a state near the critical point, depending on the installation environment (e.g., a case such as overload during summer). When the refrigerant reaches a state near the critical point in this manner, not only is there a risk of cavitation and adverse effects on the constituent parts of the refrigerant circuit, but the fluid level of the refrigerant in the liquid receiver becomes difficult to control, and it can become impossible to maintain an appropriate amount of refrigerant in the refrigerant circuit.

However, in this refrigeration device, the second control unit performs refrigerant cooling control for cooling the refrigerant that flows through the first refrigerant pipe by the first internal heat exchanger so that the refrigerant that has flowed out from the first expansion mechanism does not reach a state near the critical point. The refrigerant can therefore be prevented from reaching a state near the critical point when the refrigerant is expanded by the first expansion mechanism to a state near the saturation line in this refrigeration device.

A refrigeration device according to a ninth aspect of the present invention is the refrigeration device according to the eighth aspect of the present invention, wherein the first expansion mechanism and the second expansion mechanism are controlled in the refrigerant cooling control so that the refrigerant that has flowed out from the first expansion mechanism does not reach a state near the critical point.

In this refrigeration device, the first expansion mechanism and the second expansion mechanism are controlled in the refrigerant cooling control so that the refrigerant that has flowed out from the first expansion mechanism does not reach a state near the critical point. The refrigerant can therefore be prevented from reaching a state near the critical point when the refrigerant is expanded by the first expansion mechanism to a state near the saturation line in this refrigeration device.

A refrigeration device according to a tenth aspect of the present invention is the refrigeration device according to the eighth or ninth aspect of the present invention, wherein the refrigerant that flows through the first refrigerant pipe is cooled by the first internal heat exchanger in the refrigerant cooling control so that the pressure of the refrigerant that has flowed out from the first expansion mechanism is equal to or lower than the pressure of {critical pressure (MPa)−0.3 MPa}.

In this refrigeration device, the refrigerant that flows through the first refrigerant pipe is cooled by the first internal heat exchanger in the refrigerant cooling control so that the pressure of the refrigerant that has flowed out from the first expansion mechanism is equal to or lower than the pressure of {critical pressure (MPa)−0.3 MPa}. The refrigerant can therefore be prevented from reaching a state near the critical point when the refrigerant is expanded by the first expansion mechanism to a state near the saturation line in this refrigeration device.

A refrigeration device according to an eleventh aspect of the present invention is the refrigeration device according to the tenth aspect of the present invention, further comprising a temperature detector. The temperature detector is provided in the vicinity of an exit of the radiator or in the vicinity of a refrigerant inflow port of the first expansion mechanism. The refrigerant that flows through the first refrigerant pipe is cooled by the first internal heat exchanger in the refrigerant cooling control so that the pressure of the refrigerant that has flowed out from the first expansion mechanism is equal to or lower than the pressure of {critical pressure (MPa)−0.3 MPa} when the temperature detected by the temperature detector is equal to or above a predetermined temperature.

In this refrigeration device, the refrigerant that flows through the first refrigerant pipe is cooled by the first internal heat exchanger in the refrigerant cooling control so that the pressure of the refrigerant that has flowed out from the first expansion mechanism is equal to or lower than the pressure of {critical pressure (MPa)−0.3 MPa} when the temperature detected by the temperature detector is equal to or above a predetermined temperature. It is therefore possible in this refrigeration device to prevent the refrigerant from reaching a state near the critical point when the refrigerant is expanded by the first expansion mechanism to a state near the saturation line and there is a risk of the refrigerant reaching a state near the critical point.

A refrigeration device according to a twelfth aspect of the present invention is the refrigeration device according to any of the eighth through eleventh aspects of the present invention, wherein the second control unit has control switching section (means). The control switching means switches between normal control and the refrigerant cooling control. The term "normal control" refers to control that gives priority to COP, for example, and other control. The control switching means switches between the refrigerant cooling control and the normal control.

In this refrigeration device, the control switching means switches between the refrigerant cooling control and the normal control. It is therefore possible to execute control that takes COP into account in the refrigeration device.

Advantageous Effects of Invention

In the refrigeration device according to the first aspect, the proper degree of superheating of the refrigerant sucked into the compression mechanism can be maintained, and it is possible to impart an adequate degree of subcooling to the refrigerant that has passed through the first expansion mechanism.

In the refrigeration device according to the second aspect, a more adequate degree of subcooling can be imparted to the refrigerant that has passed through the first expansion mechanism.

In the refrigeration device according to the third aspect, the capability of the first internal heat exchanger can be adjusted.

In the refrigeration device according to the fourth aspect, the proper degree of superheating of the refrigerant sucked into the compression mechanism can be maintained by merging the refrigerant placed in a damp state by the third expansion mechanism with the refrigerant sucked into the compression mechanism in a case in which the degree of superheating of the refrigerant sucked into the compression mechanism is extremely high, for example.

In the refrigeration device according to the fifth aspect, the capability of the first internal heat exchanger can be adjusted.

In the refrigeration device according to the sixth aspect, the proper degree of superheating of the refrigerant sucked into the compression mechanism can be maintained by merging the refrigerant placed in a damp state by the third expansion mechanism with the refrigerant sucked into the compression mechanism in a case in which the degree of superheating of the refrigerant sucked into the compression mechanism is extremely high, for example.

In the refrigeration device according to the seventh aspect, the proper degree of superheating of the refrigerant sucked into the compression mechanism can be maintained in this refrigeration device.

In the refrigeration device according to the eighth aspect, the refrigerant can be prevented from reaching a state near the critical point when the refrigerant is expanded by the first expansion mechanism to a state near the saturation line.

In the refrigeration device according to the ninth aspect, the refrigerant can be prevented from reaching a state near the critical point when the refrigerant is expanded by the first expansion mechanism to a state near the saturation line.

In the refrigeration device according to the tenth aspect, the refrigerant can be prevented from reaching a state near the critical point when the refrigerant is expanded by the first expansion mechanism to a state near the saturation line.

In the refrigeration device according to the eleventh aspect, the refrigerant can be prevented from reaching a state near the critical point when the refrigerant is expanded by the first expansion mechanism to a state near the saturation line and there is a risk of the refrigerant reaching a state near the critical point.

In the refrigeration device according to the twelfth aspect, it is possible to execute control that takes COP into account.

DETAILED DESCRIPTION OF THE INVENTION

<Structure of Air Conditioning Device>

Figure 1:
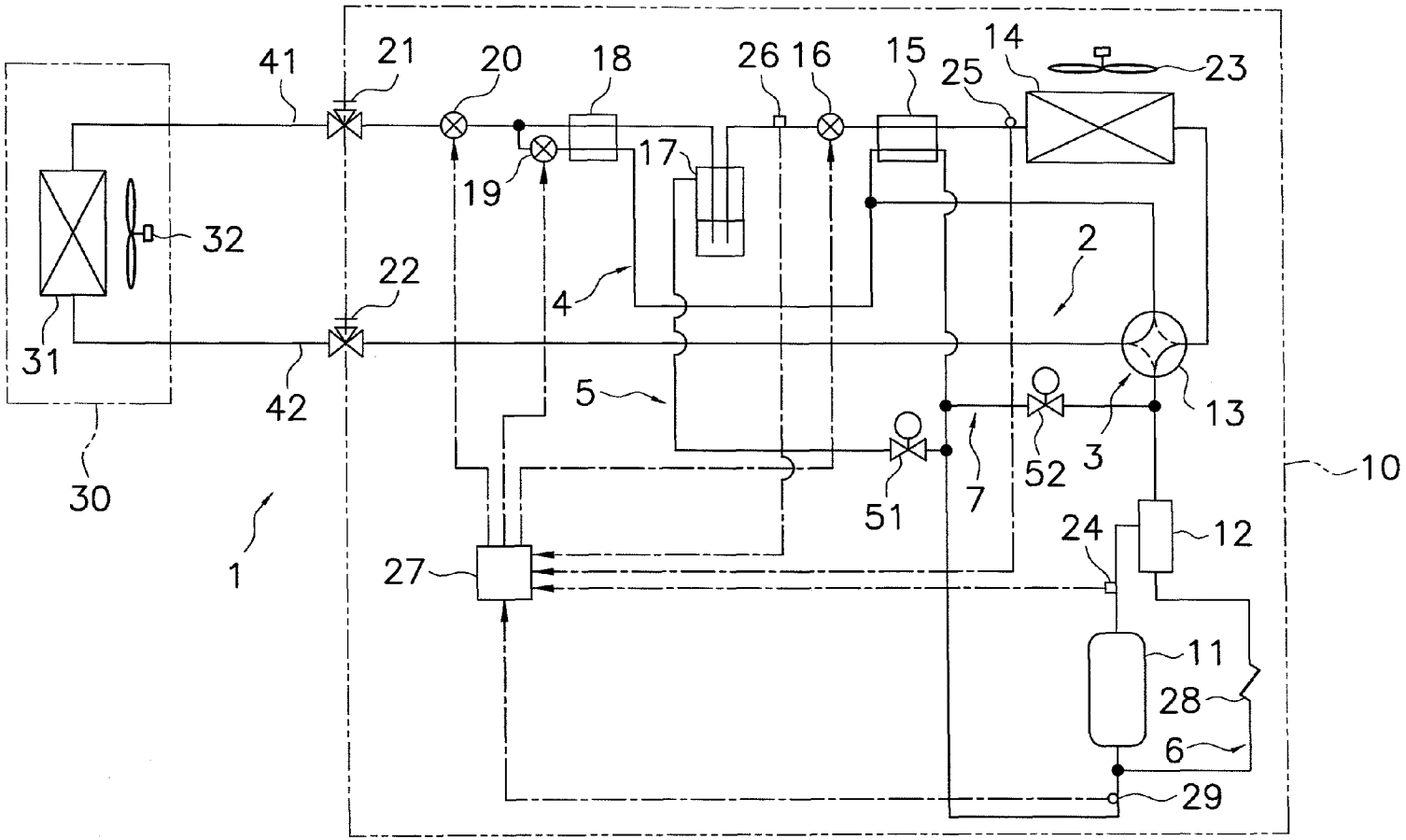
FIG. 1 is a diagram showing the refrigerant circuit of an air conditioning device according to an embodiment of the present invention.

FIG. 1 is a schematic view of the refrigerant circuit 2 of the air conditioning device 1 according to an embodiment of the present invention.

This air conditioning device 1 is an air conditioning device that is capable of cooling operation and heating operation using carbon dioxide as the refrigerant, and is primarily composed of a refrigerant circuit 2, blower fans 23, 32, a control device 27, a high-pressure sensor 24, an intermediate-pressure sensor 26, a first temperature sensor 25, a second temperature sensor 29, and other components.

The refrigerant circuit 2 is composed primarily of a main refrigerant circuit 3, a first bypass line 4, a gas outlet line 5, an oil return line 6, and a second bypass line 7. Each circuit will be described in detail below.

(1) Main Refrigerant Circuit

The main refrigerant circuit 3 is equipped primarily with a compressor 11, an oil separator 12, a four-way switch valve 13, an outdoor heat exchanger 14, a first internal heat exchanger 15, a first electric expansion valve 16, a liquid receiver 17, a second internal heat exchanger 18, a second electric expansion valve 20, and an indoor heat exchanger 31, and the devices are connected via a refrigerant pipe as shown in FIG. 1.

(2) Bypass Lines

As shown in FIG. 1, the first bypass line 4 is a line that branches from a refrigerant pipe (hereinafter referred to as the eleventh refrigerant pipe) for connecting the second internal heat exchanger 18 and the second electric expansion valve 20, and merges with a refrigerant pipe (hereinafter referred to as the twelfth refrigerant pipe) for connecting the four-way switch valve 13 and the first internal heat exchanger 15. The first bypass line 4 passes through the second internal heat exchanger 18. In the first bypass line 4, a third electric expansion valve 19 is provided in the portion that extends from the branch point with the eleventh refrigerant pipe to the second internal heat exchanger 18.

(3) Gas Outlet Line

The gas outlet line 5 is a line that extends from the upper part of the liquid receiver 17 and merges with a refrigerant pipe (hereinafter referred to as the thirteenth refrigerant pipe) for connecting the first internal heat exchanger 15 and the intake side of the compressor 11. An opening and closing valve 51 is provided to the gas outlet line 5. The opening and closing valve 51 is an electromagnetic valve or the like, for example, and the opening and closing thereof is controlled by the control device 27 described hereinafter.

(4) Oil Return Line

The oil return line 6 is a line that extends from the oil separator 12 and merges with an intake tube of the compressor 11. A capillary 28 is provided to the oil return line 6.

(5) Second Bypass Line

The second bypass line 7 is a line that branches from a refrigerant pipe for connecting the oil separator 12 and the four-way switch valve 13 and merges with a portion of the thirteenth refrigerant pipe that is between the first internal heat exchanger 15 and the merge point of the gas outlet line 5. An opening and closing valve 52 is provided to the second bypass line 7. The opening and closing valve 52 is an electromagnetic valve or the like, for example, and the opening and closing thereof is controlled by the control device 27 described hereinafter. This opening and closing valve is used for superheating the refrigerant flowing through the intake side of the compressor, and injecting high-pressure refrigerant gas to protect the low-pressure side when the pressure of the low-pressure side is too low at startup of the compressor.

In the present embodiment, the air conditioning device 1 is a separate-type air conditioning device, and can also be described as comprising an indoor unit 30, an outdoor unit 10, a first connecting pipe 41 for connecting the pipe for refrigerant fluid and the like of the indoor unit 30 and the pipe for refrigerant fluid and the like of the outdoor unit 10, and a second connecting pipe 42 for connecting the pipe for refrigerant gas and the like of the indoor unit 30 and the pipe for refrigerant gas and the like of the outdoor unit 10. The first connecting pipe 41 and the pipe for refrigerant fluid and the like of the outdoor unit 10 are connected via a first close valve 21 of the outdoor unit 10, and the second connecting pipe 42 and the pipe for refrigerant gas and the like of the outdoor unit 10 are connected via a second close valve 22 of the outdoor unit 10. The indoor unit 30 is mainly provided with the indoor heat exchanger 31 and the indoor fan 32 in the present embodiment. The outdoor unit 10 is primarily provided with the compressor 11, the oil separator 12, the four-way switch valve 13, the outdoor heat exchanger 14, the first internal heat exchanger 15, the first electric expansion valve 16, the liquid receiver 17, the second internal heat exchanger 18, the second electric expansion valve 20, the third electric expansion valve 19, the opening and closing valves 51, 52, the capillary 28, the high-pressure sensor 24, the intermediate-pressure sensor 26, the first temperature sensor 25, the second temperature sensor 29, the control device 27, and an outdoor fan 23.

(1) Indoor Unit

The indoor unit 30 primarily has the indoor heat exchanger 31, the indoor fan 32, and other components.

The indoor heat exchanger 31 is a heat exchanger for exchanging heat between the refrigerant and the indoor air, which is the air inside the room to be air-conditioned.

The indoor fan 32 is a fan for taking the air inside the air-conditioned room into the unit 30 and blowing conditioned air, which is the air after heat exchange with the refrigerant via the indoor heat exchanger 31, back into the air-conditioned room.

Employing such a configuration makes it possible for the indoor unit 30 to cause heat to be exchanged between the indoor air taken in by the indoor fan 32 and the liquid refrigerant that flows through the indoor heat exchanger 31, and generate conditioned air (cool air) during cooling operation, as well as to cause heat to be exchanged between the indoor air taken in by the indoor fan 32 and supercritical refrigerant that flows through the indoor heat exchanger 31, and generate conditioned air (warm air) during heating operation.

(2) Outdoor Unit

The outdoor unit 10 primarily has the compressor 11, the oil separator 12, the four-way switch valve 13, the outdoor heat exchanger 14, the outdoor fan 23, the first internal heat exchanger 15, the first electric expansion valve 16, the liquid receiver 17, the second internal heat exchanger 18, the second electric expansion valve 20, the third electric expansion valve 19, the opening and closing valves 51, 52, the capillary 28, the high-pressure sensor 24, the intermediate-pressure sensor 26, the first temperature sensor 25, the second temperature sensor 29, the control device 27, and other components.

The compressor 11 is a device for sucking in low-pressure refrigerant gas flowing through an intake pipe and compressing the refrigerant gas to a supercritical state, and then discharging the refrigerant to a discharge pipe.

The oil separator 12 is a device for separating freezer oil that is mixed in with the refrigerant discharged from the compressor 11.

The four-way switch valve 13 is a valve for switching the flow direction of the refrigerant in accordance with each operation mode, and is capable of connecting the discharge side of the compressor 11 and the high-temperature side of the outdoor heat exchanger 14, and connecting the intake side of the compressor 11 and the gas side of the indoor heat exchanger 31 via the first internal heat exchanger 15 during cooling operation; as well as connecting the discharge side of the compressor 11 and the second close valve 22, and connecting the intake side of the compressor 11 and the gas side of the outdoor heat exchanger 14 during heating operation.

The outdoor heat exchanger 14 is capable of cooling the high-pressure supercritical refrigerant discharged from the compressor 11 using the air outside the air-conditioned room as a heat source during cooling operation, and evaporating the liquid refrigerant returning from the indoor heat exchanger 31 during heating operation.

The outdoor fan 23 is a fan for drawing outside air into the unit 10 and discharging the air after heat exchange with the refrigerant via the outdoor heat exchanger 14.

The first internal heat exchanger 15 is a heat exchanger formed by placing close to each other the refrigerant pipe (hereinafter referred to as the fourteenth refrigerant pipe) for connecting the first electric expansion valve 16 and the low-temperature side (or liquid side) of the outdoor heat exchanger 14, and the refrigerant pipe (hereinafter referred to as the fifteenth refrigerant pipe) for connecting the four-way switch valve 13 and the intake side of the compressor 11. In the internal heat exchanger 15, heat is exchanged between the high-temperature high-pressure supercritical refrigerant flowing through the fourteenth refrigerant pipe, and the low-temperature low-pressure refrigerant gas flowing through the fifteenth refrigerant pipe during cooling operation.

The first electric expansion valve 16 reduces the pressure of the supercritical refrigerant (during cooling operation) that flows out from the low-temperature side of the outdoor heat exchanger 14, or the liquid refrigerant (during heating operation) that flows in through the liquid receiver 17.

The liquid receiver 17 stores refrigerant that occurs as excess depending on the operating mode or the air conditioning load.

The second internal heat exchanger 18 is a heat exchanger formed by placing close to each other the refrigerant pipe (hereinafter referred to as the sixteenth refrigerant pipe) for connecting the liquid receiver 17 and the second electric expansion valve 20, and the first bypass line 4 (portion between the third electric expansion valve 19 and the merge point with the twelfth refrigerant pipe). In the second internal heat exchanger 18, heat is exchanged between the refrigerant in a saturated state flowing in the sixteenth refrigerant pipe, and the refrigerant flowing in the first bypass line 4.

The second electric expansion valve 20 reduces the pressure of the liquid refrigerant (during cooling operation) that flows out from the liquid receiver 17 and through the second internal heat exchanger 18, or the supercritical refrigerant (during heating operation) that flows out from the low-temperature side of the indoor heat exchanger 31.

The third electric expansion valve 19 reduces the pressure of the liquid refrigerant (during cooling operation) that flows out from the liquid receiver 17 and passes through the second internal heat exchanger 18.

The opening and closing of the opening and closing valves 51, 52 are controlled by the control device 27 as described above.

The capillary 28 reduces the pressure of oil-rich refrigerant that flows out from the oil separator 12 and evaporates the oil-rich refrigerant.

The high-pressure sensor 24 is provided to the discharge side of the compressor 11.

The intermediate-pressure sensor 26 is provided between the first electric expansion valve 16 and the liquid receiver 17.

The first temperature sensor 25 is provided in the vicinity of the low-temperature side (or liquid side) of the outdoor heat exchanger 14.

The second temperature sensor 29 is provided to the intake side of the compressor 11.

Figure 2:
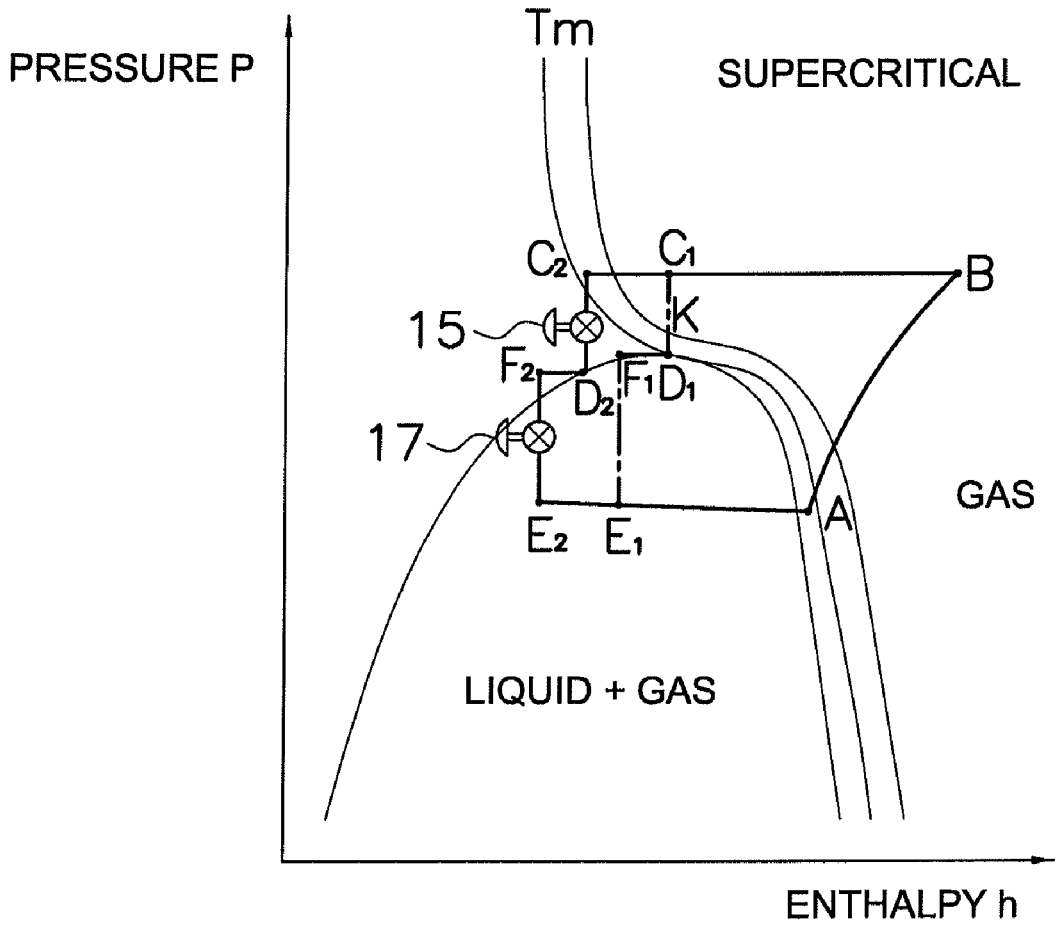
FIG. 2 is a diagram for describing refrigerant cooling control by the control device of the air conditioning device according to an embodiment of the present invention.

The control device 27 has a communication connection with the high-pressure sensor 24, the intermediate-pressure sensor 26, the first temperature sensor 25, the second temperature sensor 29, the first electric expansion valve 16, the second electric expansion valve 20, the third electric expansion valve 19, and other components, and controls the degree of opening of the first electric expansion valve 16 and the second electric expansion valve 20 on the basis of temperature information transmitted from the first temperature sensor 25, high-pressure information transmitted from the high-pressure sensor 24, and intermediate-pressure information transmitted from the intermediate-pressure sensor 26. The control device 27 also controls the degree of opening of the third electric expansion valve 19 so that the temperature information transmitted from the second temperature sensor 29 is within a predetermined range. The control device 27 is also provided with control switching functionality (i.e., control switching section or means) for switching between normal control and refrigerant cooling control on the basis of high-pressure information and the temperature information of the first temperature sensor 25 during cooling operation. In normal control, the degree of opening of the first electric expansion valve 16, the second electric expansion valve 20, and the third electric expansion valve 19 is controlled so that COP or the like is enhanced. In refrigerant cooling control, the degree of opening of the first electric expansion valve 16 and the second electric expansion valve 20 is controlled so that the state of the refrigerant that has flowed out from the first electric expansion valve 16 is on the saturation line and not near the critical point to maintain the state of the refrigerant in the liquid receiver 17 at saturation. The refrigerant cooling control will be described in detail using a Mollier diagram. FIG. 2 shows the refrigeration cycle of the air conditioning device 1 according to the present embodiment on a Mollier diagram for carbon dioxide. In FIG. 2, $A \rightarrow B$ indicates the compression stroke, $B \rightarrow C_1$, $C_2$ indicates the first cooling stroke (wherein $B \rightarrow C_1$ is cooling by the outdoor heat exchanger 14, and $C_1 \rightarrow C_2$ is cooling by the first internal heat exchanger 15), $C_1$, $C_2 \rightarrow D_1$, $D_2$ indicates the first expansion stroke (pressure reduction by the first electric expansion valve 16), $D_1$, $D_2 \rightarrow F_1$, $F_2$ indicates the second cooling stroke (wherein $D_1 \rightarrow F_1$ and $D_2 \rightarrow F_2$ indicate cooling by the second internal heat exchanger 18), $F_1$, $F_2 \rightarrow E_1$, $E_2$ indicates the second expansion stroke (pressure reduction by the second electric expansion valve 20), and $E_1$, $E_2 \rightarrow A$ indicates the evaporation stroke. Also, K indicates the critical point (in FIG. 2, point K and point $D_1$ overlap), and Tm is the isothermal line. According to the refrigeration cycle of $A \rightarrow B \rightarrow C_1 \rightarrow D_1(K) \rightarrow F_1 \rightarrow E_1 \rightarrow A$, the refrigerant that has flowed out from the first electric expansion valve 16 is in a state near the critical point. However, since the high-pressure sensor 24 is disposed on the discharge side of the compressor 11, and the first temperature sensor 25 is disposed in the vicinity of the low-temperature side of the outdoor heat exchanger 14 in the air conditioning device 1 of the present embodiment, it is possible to detect that the refrigerant that has flowed out from the first electric expansion valve 16 has reached the state of point $C_1$. Therefore, when the refrigerant that has flowed out from the first electric expansion valve 16 is detected reaching the state of point $C_1$ in this air conditioning device 1, the degree of opening of the first electric expansion valve 16 and the second electric expansion valve 20 is appropriately adjusted to cool the refrigerant that has flowed out from the first electric expansion valve 16 to the state of point $C_2$. The refrigeration cycle is thereby changed to the refrigeration cycle of $A \rightarrow B \rightarrow C_2 \rightarrow D_2 \rightarrow F_2 \rightarrow E_2 \rightarrow A$. In other words, since the refrigerant is cooled to the state of point $C_2$, the refrigerant can be placed in a state near the saturation line and not near the critical point. In the present embodiment, the control device 27 controls the first electric expansion valve 16 and the second electric expansion valve 20 so that the pressure indicated by the intermediate-pressure sensor 26 is equal to or lower than the pressure of {critical pressure (MPa)−0.3 (MPa)}. The pressure of {critical pressure (MPa)−0.3 (MPa)} is determined in the following manner. The results of tests performed by the inventors show that the pressure (hereinafter referred to as the intermediate pressure) between the first electric expansion valve 16 and the second electric expansion valve 20 can be controlled to within a range of about ±0.1 MPa from the target value in the case of the refrigerant. In order to prevent the intermediate pressure from coming near the critical point, the target value of the intermediate pressure is preferably the critical pressure (MPa)−0.3 (MPa), with a safety factor of 3.

In the present embodiment, normal control is automatically performed when there is no need for refrigerant cooling control.

<Operation of the Air Conditioning Device>

The operation of the air conditioning device 1 will be described using FIG. 1. This air conditioning device 1 is capable of cooling operation and heating operation, as described above.

(1) Cooling Operation

During cooling operation, the four-way switch valve 13 is in the state indicated by the solid line in FIG. 1, i.e., a state in which the discharge side of the compressor 11 is connected to the high-temperature side of the outdoor heat exchanger 14, and the intake side of the compressor 11 is connected to the second close valve 22 via the first internal heat exchanger 15. The first close valve 21 and the second close valve 22 are also open at this time.

When the compressor 11 is activated in this state of the refrigerant circuit 2, the refrigerant gas is sucked into the compressor 11 and compressed to a supercritical state, and then sent through the oil separator 12 and the four-way switch valve 13 to the outdoor heat exchanger 14 and cooled in the outdoor heat exchanger 14. At this time, freezer oil that is mixed in with the refrigerant is separated by the oil separator 12. The separated freezer oil is then taken back into the compressor 11 through the oil return line 6.

The cooled supercritical refrigerant is sent to the first electric expansion valve 16 through the first internal heat exchanger 15. At this time, the supercritical refrigerant is cooled by the low-temperature refrigerant gas that flows in the fifteenth refrigerant pipe of the first internal heat exchanger 15. The supercritical refrigerant sent to the first electric expansion valve 16 is depressurized to a saturated state, and then sent to the third electric expansion valve 19 as well as to the second electric expansion valve 20 via the liquid receiver 17 and the second internal heat exchanger 18. At this time, the refrigerant in a saturated state sent to the second electric expansion valve 20 is cooled by the refrigerant depressurized by the third electric expansion valve 19 and flowing into the first bypass line 4. The refrigerant in a saturated state sent to the second electric expansion valve 20 is depressurized to liquid refrigerant, and then fed to the indoor heat exchanger 31 via the first close valve 21, and the liquid refrigerant cools the indoor air and evaporates into refrigerant gas.

The refrigerant gas passes through the second close valve 22 and the four-way switch valve 13, merges with the refrigerant that has then been depressurized by the third electric expansion valve 19 and that has flowed into the first bypass line 4, and flows into the first internal heat exchanger 15. This merged refrigerant is then heated by the high-temperature high-pressure supercritical refrigerant that flows to the fourteenth refrigerant pipe of the first internal heat exchanger 15, and is then sucked back into the compressor 11.

Cooling operation is performed in this manner. The control device 27 at this time appropriately switches between normal control and refrigerant cooling control on the basis of temperature information and high-pressure information in the manner described above.

(2) Heating Operation

During heating operation, the four-way switch valve 13 is in the state indicated by the dashed line in FIG. 1, i.e., a state in which the discharge side of the compressor 11 is connected to the second close valve 22, and the intake side of the compressor 11 is connected to the gas side of the outdoor heat exchanger 14. The first close valve 21 and the second close valve 22 are also open at this time.

When the compressor 11 is activated in this state of the refrigerant circuit 2, the refrigerant gas is sucked into the compressor 11 and compressed to a supercritical state, and then is fed to the indoor heat exchanger 31 via the oil separator 12, the four-way switch valve 13, and the second close valve 22. At this time, freezer oil that is mixed in with the refrigerant is separated by the oil separator 12. The separated freezer oil is then taken back into the compressor 11 through the oil return line 6.

The supercritical refrigerant heats the indoor air, and is cooled in the indoor heat exchanger 31. The cooled supercritical refrigerant is sent through the first close valve 21 to the second electric expansion valve 20. Since the third electric expansion valve 19 is closed at this time, the supercritical refrigerant does not flow into the first bypass line 4. The supercritical refrigerant sent to the second electric expansion valve 20 is depressurized to a saturated state, and then sent to the first electric expansion valve 16 via the liquid receiver 17. The refrigerant in a saturated state sent to the first electric expansion valve 16 is depressurized to liquid refrigerant, and then sent to the outdoor heat exchanger 14 and evaporated to refrigerant gas in the outdoor heat exchanger 14. This refrigerant gas is again sucked into the compressor 11 via the four-way switch valve 13.

Heating operation is performed in this manner.

<Characteristics of the Air Conditioning Device>

(1)

During cooling operation in the air conditioning device 1 according to the present embodiment, heat is exchanged in the second internal heat exchanger 18 between the refrigerant that flows out from the first electric expansion valve 16, and the refrigerant that flows out from the third electric expansion valve 19. An adequate degree of subcooling can therefore be imparted to the refrigerant that has passed through the first electric expansion valve 16 in this air conditioning device 1.

(2)

In the air conditioning device 1 according to the present embodiment, the first bypass line 4 that branches from the eleventh refrigerant pipe and merges with the twelfth refrigerant pipe passes through the second internal heat exchanger 18. In this first bypass line 4, the third electric expansion valve 19 is provided in the portion that extends from the branch point with the eleventh refrigerant pipe to the second internal heat exchanger 18. The capability of the first internal heat exchanger 15 can therefore be adjusted to maintain the proper degree of superheating in the refrigerant sucked into the compressor 11 in the air conditioning device 1.

(3)

In the air conditioning device 1 according to the present embodiment, the first electric expansion valve 16 and the second electric expansion valve 20 are controlled so that the state of the refrigerant that has flowed out from the first electric expansion valve 16 is on the saturation line, and so that the pressure of the refrigerant at this time is equal to or lower than the pressure of {critical pressure (MPa)−0.3 (MPa)}. It is therefore possible to prevent the refrigerant from reaching a state near the critical point when the refrigerant is expanded to a state near the saturation line by the first electric expansion valve 16 in the air conditioning device 1.

(4)

In the air conditioning device 1 according to the present embodiment, the control device 27 is provided with functionality for switching between refrigerant cooling control and normal control. It is therefore possible to execute control that takes COP into account in the air conditioning device 1.

<Modifications>

(A)

Figure 3:
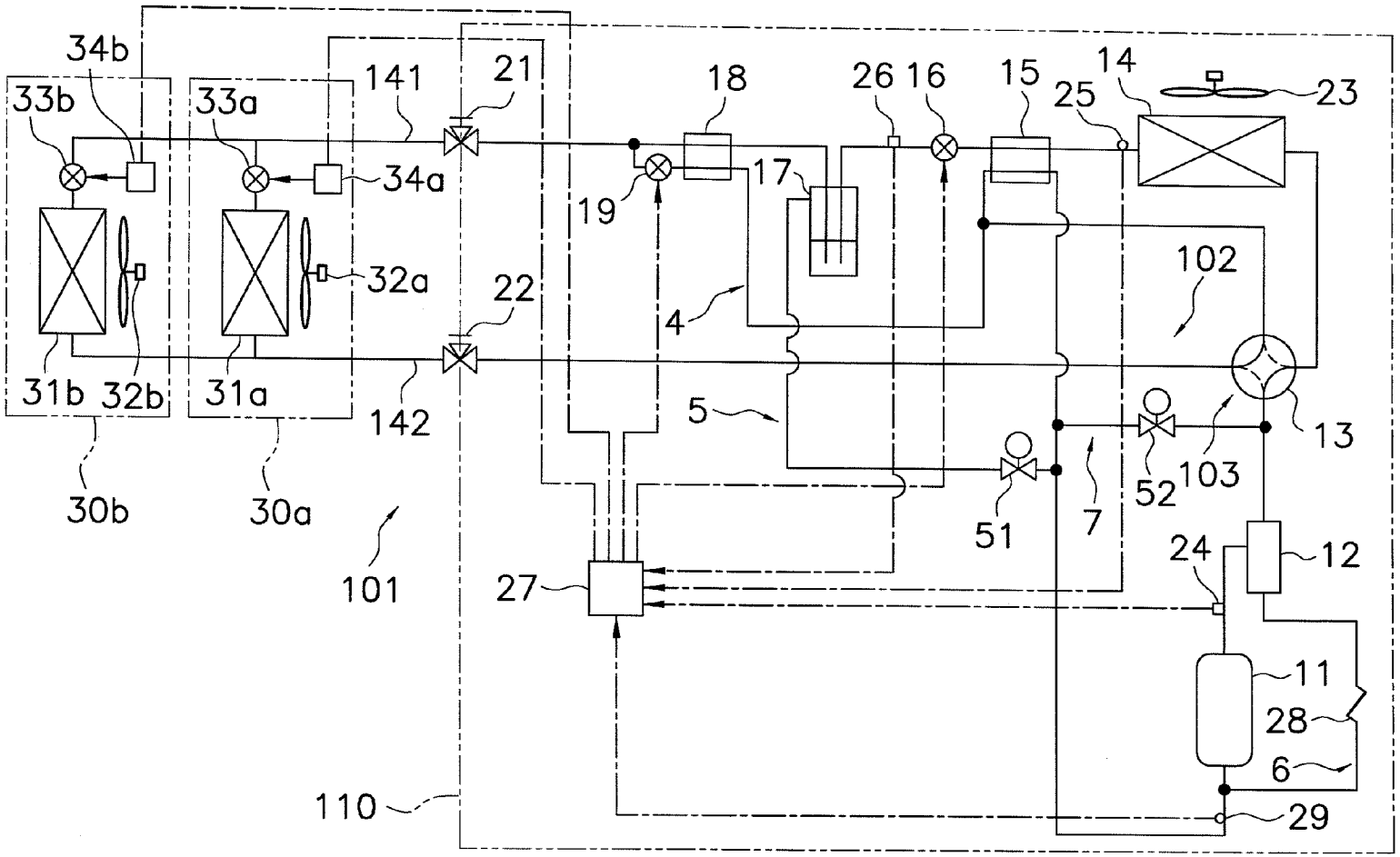
FIG. 3 is a diagram showing the refrigerant circuit of the air conditioning device according to Modification (A).

In the embodiment described above, the invention of the present application is applied to a separate-type air conditioning device 1 in which one indoor unit 30 is provided for one outdoor unit 10, but the invention of the present application may also be applied to a multi-type air conditioning device 101 in which a plurality of indoor units is provided for one outdoor unit, such as shown in FIG. 3. In FIG. 3, the same reference numerals are used to refer to components that are the same as those of the air conditioning device 1 according to the embodiment described above. In FIG. 3, the reference numeral 102 refers to a refrigerant circuit, 103 refers to a main refrigerant circuit, 110 refers to an outdoor unit, 30*a* and 30*b* refer to indoor units, 31*a* and 31*b* refer to indoor heat exchangers, 32*a* and 32*b* refer to indoor fans, 33*a* and 33*b* refer to second electric expansion valves, 34*a* and 34*b* refer to indoor control devices, and 141 and 142 refer to connecting pipes. In this case, the control device 27 controls the second electric expansion valves 33*a*, 33*b* via the indoor control devices 34*a*, 34*b*. The second electric expansion valves 33*a*, 33*b* are housed in the indoor units 30*a*, 30*b* in the present modification, but the second electric expansion valves 33*a*, 33*b* may also be housed in the outdoor unit 110.

(B)

A first internal heat exchanger 15 in which the fourteenth refrigerant pipe and the fifteenth refrigerant pipe are placed close to each other is used in the air conditioning device 1 according to the embodiment described above, but a dual-pipe heat exchanger may also be used as the first internal heat exchanger.

(C)

A second internal heat exchanger 18 in which the sixteenth refrigerant pipe and the first bypass line 4 are placed close to each other is used in the air conditioning device 1 according to the embodiment described above, but a dual-pipe heat exchanger may also be used as the second internal heat exchanger.

(D)

Figure 4:
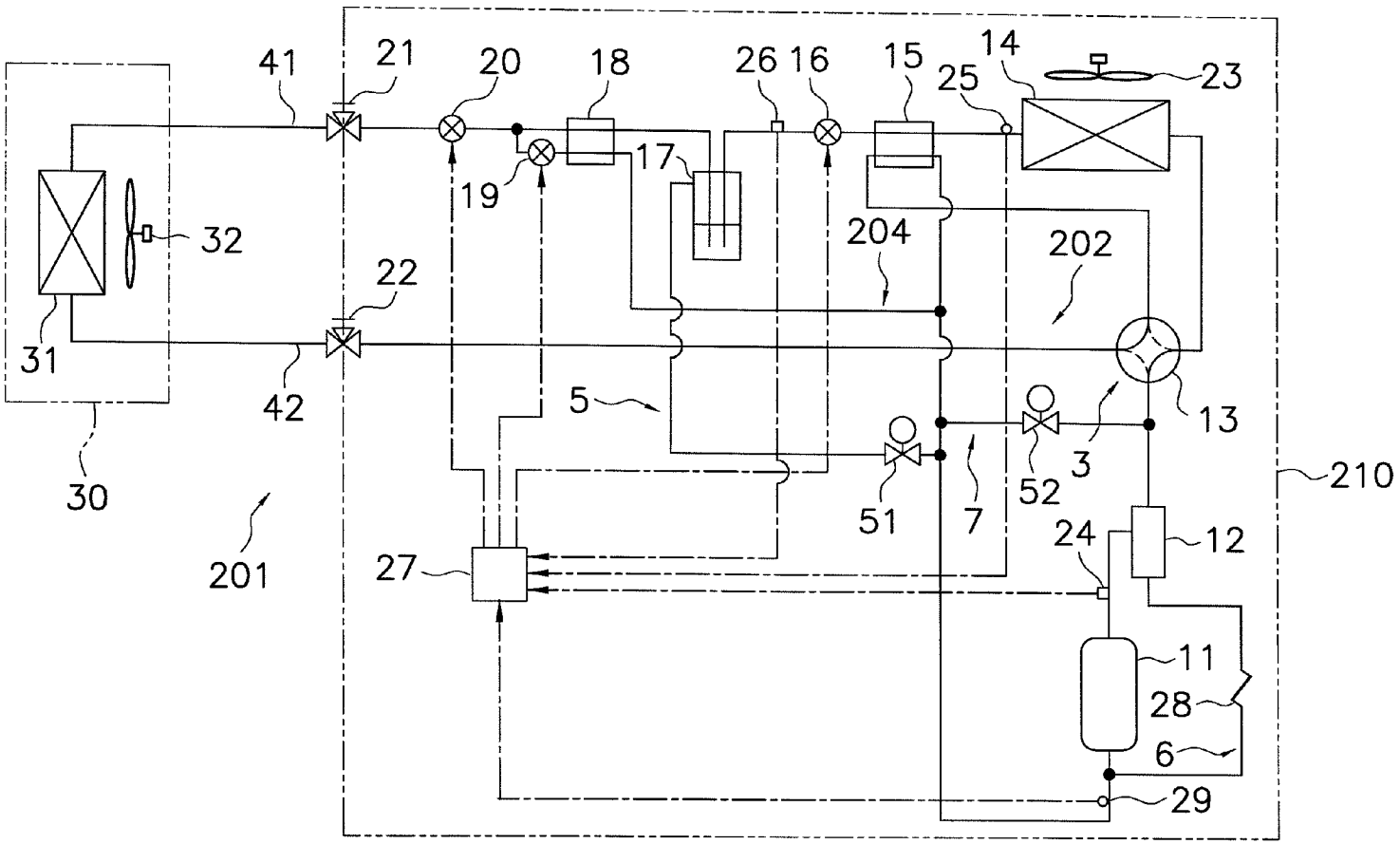
FIG. 4 is a diagram showing the refrigerant circuit of the (separate-type) air conditioning device according to Modification (D).

In the air conditioning device 1 according to the embodiment described above, the first bypass line 4 merges with the twelfth refrigerant pipe, but a configuration may instead be adopted in which the first bypass line 4 merges with a refrigerant pipe for connecting the first internal heat exchanger 15 and the intake side of the compressor 11, as shown in FIG. 4. In this instance, the refrigerant that has flowed out from the evaporator 31 passes through the first internal heat exchanger 15 and then merges with the refrigerant that flows in from a bypass line 204. Consequently, when the refrigerant that has flowed out from the evaporator 31 is overly superheated, the degree of superheating of the refrigerant can be reduced to the proper degree by controlling the third electric expansion valve 19 so that the refrigerant that flows to the bypass line 204 is in a damp state.

Figure 5:
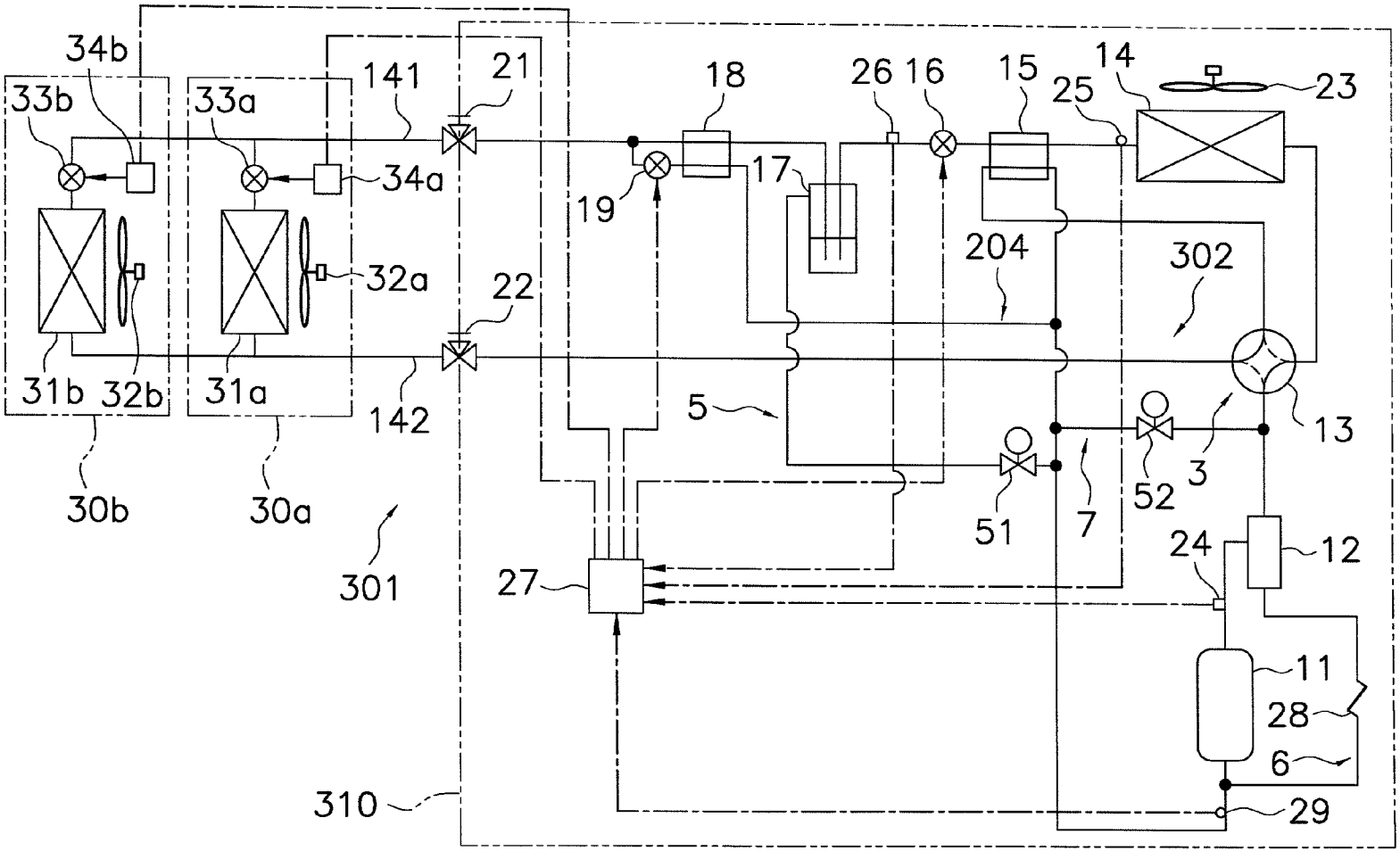
FIG. 5 is a diagram showing the refrigerant circuit of the (multi-type) air conditioning device according to Modification (D).

In FIG. 4, the same reference numerals are used to refer to components that are the same as those of the air conditioning device 1 according to the embodiment described above. The additional reference numerals 201, 202, 204, and 210 refer to an air conditioning device, a refrigerant circuit, a bypass line, and an outdoor unit, respectively. This technique may also be used in a multi-type air conditioning device 301 (see FIG. 5) in the same manner as in Modification (A). In FIG. 5, the same reference numerals are used to refer to components that are the same as those of the air conditioning devices 1, 201 described above and according to the embodiment described above. The additional reference numerals 302 and 310 refer to a refrigerant circuit and an outdoor unit, respectively.

(E)

The high-pressure sensor 24 is provided to the discharge side of the compressor 11 in the air conditioning device 1 according to the embodiment described above, but the high-pressure sensor 24 may also be omitted. In this case, the degree of opening of the first electric expansion valve 16, the second electric expansion valve 20, and the third electric expansion valve 19 may be controlled so that the state of the refrigerant that has flowed out from the first electric expansion valve 16 is on the saturation line, and so that the pressure of the refrigerant is then equal to or lower than the pressure of {critical pressure (MPa)−0.3 (MPa)} when the temperature obtained from the first temperature sensor 25 positioned on the low-temperature side (or liquid side) of the outdoor heat exchanger 14 is equal to or above a predetermined temperature.

(F)

In the air conditioning device 1 according to the embodiment described above, the first internal heat exchanger 15, the second internal heat exchanger 18, the first electric expansion valve 16, the liquid receiver 17, the second electric expansion valve 20, and other components are disposed in the outdoor unit 10, but the positioning of these components is not particularly limited. For example, the second electric expansion valve 20 may be disposed in the indoor unit 30.

(G)

Figure 6:
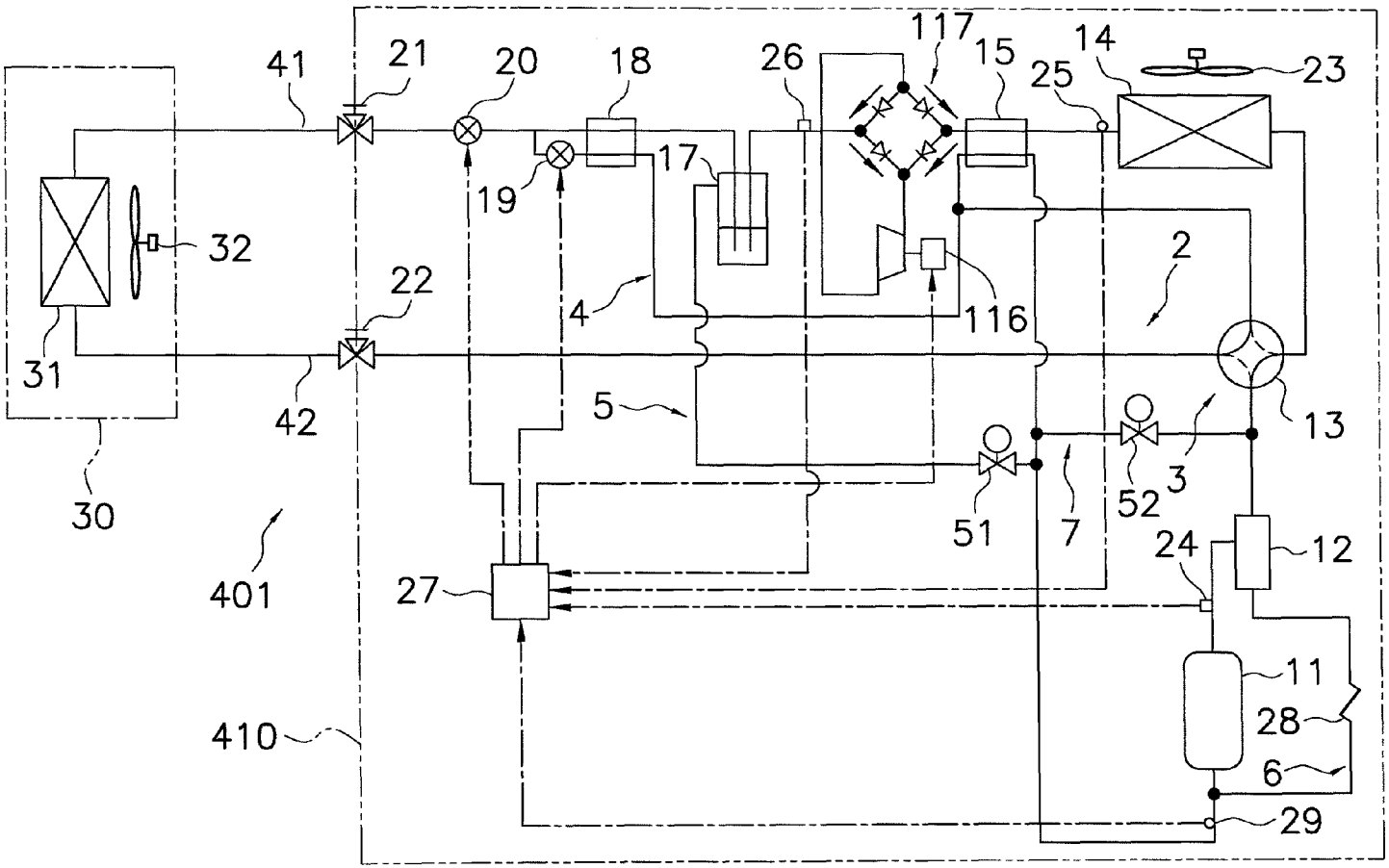
FIG. 6 is a diagram showing the refrigerant circuit of the air conditioning device according to Modification (G).

An electric expansion valve is used as the means for reducing the pressure of the refrigerant in the air conditioning device 1 according to the embodiment described above, but an expansion device 116 or the like such as shown in FIG. 6 may instead be used. In such an air conditioning device 401, a bridge circuit 117 must be provided to the refrigerant inflow side of the expansion device 116 in the outdoor device 410, as shown in FIG. 6. The reason for this is that the expansion device 116 has directionality.

(H)

The temperature sensor 25 is provided in the vicinity of the port on the low-temperature side (or liquid side) of the outdoor heat exchanger 14 in the air conditioning device 1 according to the embodiment described above, but the temperature sensor 25 may alternatively be provided in the vicinity of the port on the first internal heat exchanger side of the first electric expansion valve 16.

(I)

Figure 7:
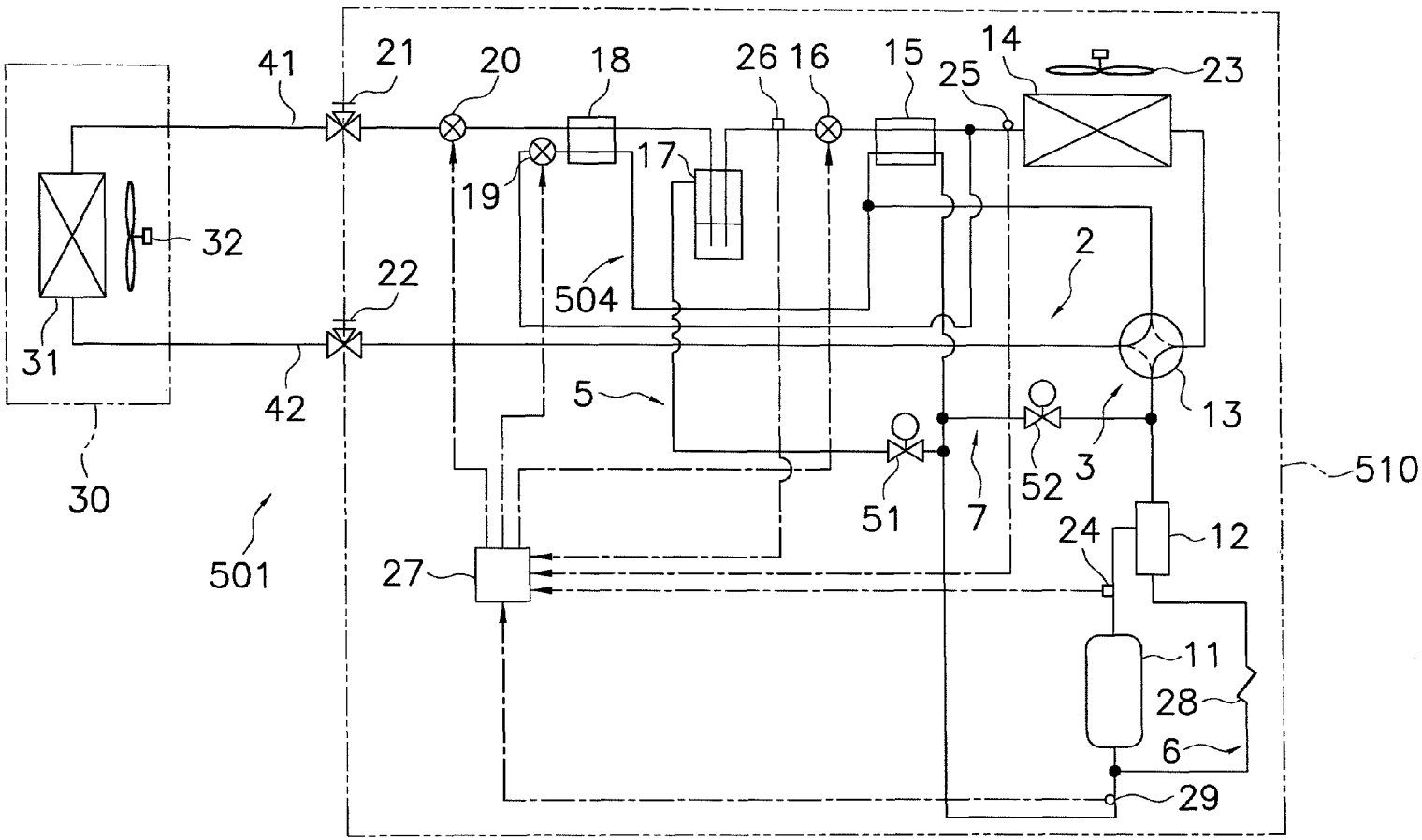
FIG. 7 is a diagram showing the refrigerant circuit of the air conditioning device according to Modification (I).

In the air conditioning device 1 according to the embodiment described above, the first bypass line 4 branches from a refrigerant pipe for connecting the second internal heat exchanger 18 and the second electric expansion valve 20, but the first bypass line may alternatively branch from a refrigerant pipe for connecting the outdoor heat exchanger 14 and the first internal heat exchanger 15, as shown in FIG. 7. In FIG. 7, the reference numeral 501 refers to the air conditioning device according to the present modification, 510 refers to the outdoor device according to the present modification, and 504 refers to the first bypass line according to the present modification.

(J)

Figure 8:
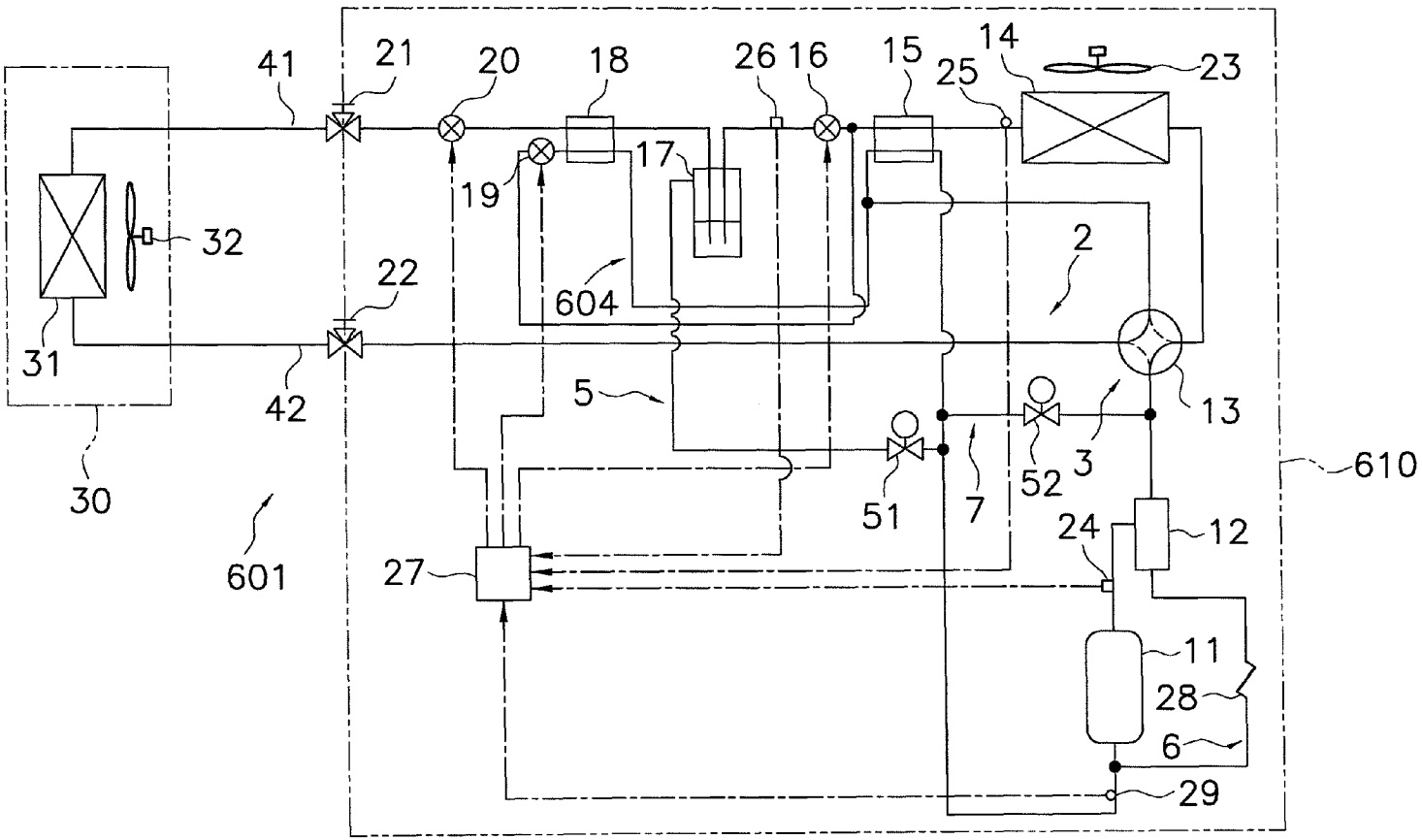
FIG. 8 is a diagram showing the refrigerant circuit of the air conditioning device according to Modification (J).

In the air conditioning device 1 according to the embodiment described above, the first bypass line 4 branches from a refrigerant pipe for connecting the second internal heat exchanger 18 and the second electric expansion valve 20, but the first bypass line may alternatively branch from a refrigerant pipe for connecting the first internal heat exchanger 15 and the first electric expansion valve 16, as shown in FIG. 8. In FIG. 8, the reference numeral 601 refers to the air conditioning device according to the present modification, 610 refers to the outdoor device according to the present modification, and 604 refers to the first bypass line according to the present modification.

(K)

In the air conditioning device 1 according to the embodiment described above, the first bypass line 4 branches from a refrigerant pipe for connecting the second internal heat exchanger 18 and the second electric expansion valve 20, but the first bypass line may alternatively branch from a refrigerant pipe for connecting the first electric expansion valve 16 and the second internal heat exchanger 18 (not shown). In this case, the branch point may be positioned in front of or behind the liquid receiver 17.

INDUSTRIAL APPLICABILITY

The refrigeration device of the present invention has the characteristic of making it possible to impart an adequate degree of subcooling to the refrigerant that has passed through the first expansion mechanism, and the present invention is particularly useful in a refrigeration device in which carbon dioxide or the like is used as the refrigerant.

What is claimed is:

1. A refrigeration device comprising:

a compression mechanism configured to compress a refrigerant;

a radiator connected to a refrigerant discharge side of said compression mechanism;

a first expansion mechanism connected to an exit side of said radiator;

a second expansion mechanism connected to a refrigerant outflow side of said first expansion mechanism;

an evaporator connected to the refrigerant outflow side of said second expansion mechanism and to a refrigerant intake side of said compression mechanism;

a first internal heat exchanger configured to cause heat to be exchanged between refrigerant flowing in a first refrigerant pipe and refrigerant flowing in a second refrigerant pipe, the first refrigerant pipe connecting the exit side of said radiator and an inflow side of said first expansion mechanism, and the second refrigerant pipe connecting the exit side of said evaporator and the refrigerant inflow side of said compression mechanism;

a branch pipe branching from a third refrigerant pipe and merging with said second refrigerant pipe, said third refrigerant pipe connecting the exit side of said radiator and a refrigerant inflow side of said second expansion mechanism;

a third expansion mechanism provided in said branch pipe;

a second internal heat exchanger configured to cause heat to be exchanged between refrigerant flowing out from said first expansion mechanism and refrigerant flowing out from said third expansion mechanism; and a liquid receiver arranged between the refrigerant outflow side of said first expansion mechanism and an inflow port for refrigerant flowing through said first refrigerant pipe of said second internal heat exchanger, said branch pipe merging with said second refrigerant pipe so that refrigerant flowing out from said third expansion mechanism and undergoing heat exchange in said second internal heat exchanger merges with refrigerant flowing through said second refrigerant pipe before flowing into said first internal heat exchanger.

2. The refrigeration device according to claim 1, wherein said branch pipe merges with a part of said second refrigerant pipe, which is connected to an entry side of said first internal heat exchanger.

3. The refrigeration device according to claim 1, wherein said branch pipe merges with a part of said second refrigerant pipe, which is connected to an exit side of said first internal heat exchanger.

4. The refrigeration device according to claim 1, further comprising:

a control unit configured to control the third expansion mechanism so that a degree of superheating of refrigerant flowing to the refrigerant intake side of said compression mechanism from a merging point of said branch pipe with said second refrigerant pipe is within a predetermined range.

5. The refrigeration device according to claim 1, further comprising:

a control unit configured to perform refrigerant cooling control, refrigerant flowing through the first refrigerant pipe being cooled by said first internal heat exchanger so that refrigerant flowing out from said first expansion mechanism does not reach a state near the critical point when the refrigerant cooling control is performed.

6. The refrigeration device according to claim 5, wherein said first expansion mechanism and said second expansion mechanism are controlled so that refrigerant flowing out from said first expansion mechanism does not reach a state near the critical point when the refrigerant cooling control is performed.

7. The refrigeration device according to claim 5, wherein refrigerant flowing through said first refrigerant pipe is cooled by said first internal heat exchanger so that a pressure of refrigerant flowing out from said first expansion mechanism is equal to or lower than a critical pressure minus 0.3 MPa when the refrigerant cooling control is performed.

8. The refrigeration device according to claim 7, further comprising:

a temperature detector arranged to detect a refrigerant temperature in a vicinity of an exit of said radiator or in a vicinity of a refrigerant inflow port of said first expansion mechanism; wherein refrigerant flowing through said first refrigerant pipe is cooled by said first internal heat exchanger so that the pressure of the refrigerant out from said first expansion mechanism is equal to or lower than the critical pressure minus 0.3 MPa when the temperature detected by said temperature detector is equal to or above a predetermined temperature, when the refrigerant cooling control is performed.

9. The refrigeration device according to claim 5, wherein said control unit includes a control switching section for switching between normal control and said refrigerant cooling control.

10. The refrigeration device according to claim 1, wherein said branch pipe merges with a part of said second refrigerant pipe, which is connected to an exit side of said first internal heat exchanger.

11. A refrigeration comprising:

a compression mechanism configured to compress a refrigerant;

a radiator connected to a refrigerant discharge side of side of said compression mechanism;

a first expansion mechanism connected to an exit side of said radiator;

a second expansion mechanism connected to a refrigerant outflow side of said first expansion mechanism;

an evaporator connected to the refrigerant outflow side of said second expansion mechanism and to a refrigerant intake side of said compression mechanism;

a first internal heat exchanger configured to cause heat to be exchanged between refrigerant flowing in a first refrigerant pipe and refrigerant flowing in a second refrigerant pipe, the first refrigerant pipe connecting the exit side of said radiator and an inflow side of said first expansion mechanism, the second refrigerant pipe connecting the exit side of said evaporator and the refrigerant inflow side of said compression mechanism;

a branch pipe branching from a third refrigerant pipe and merging with said second refrigerant pipe, said third refrigerant pipe connecting the exit side of said radiator and a refrigerant inflow side of said second expansion mechanism;

a third expansion mechanism provided in said branch pipe;

a second internal heat exchanger configured to cause heat to be exchanged between refrigerant flowing out from said first expansion mechanism and refrigerant flowing out from said third expansion mechanism; and a liquid receiver arranged between the refrigerant outflow side of said first expansion mechanism and an inflow port for refrigerant flowing through said first refrigerant pipe of said second internal heat exchanger, said branch pipe merging with said second refrigerant pipe so that refrigerant flowing from said third expansion mechanism and undergoing heat exchange in said second internal heat exchanger merges with refrigerant flowing through said second refrigerant pipe after passing through said first internal heat exchanger.

12. The refrigeration device according to claim 11, wherein said branch pipe merges with a part of said second refrigerant pipe, which is connected to an entry side of said first internal heat exchanger.

13. The refrigeration device according to claim 11, further comprising:

a control unit configured to control the third expansion mechanism so that a degree of superheating of refrigerant flowing to the refrigerant intake side of said compression mechanism from a merging point of said branch pipe with said second refrigerant pipe is within a predetermined range.

14. The refrigeration device according to claim 11, further comprising:

a control unit configured to perform refrigerant cooling control, the refrigerant flowing through the first refrigerant pipe being cooled by said first internal heat exchanger so that the refrigerant flowing out from said first expansion mechanism does not reach a state near the critical point when the refrigerant cooling control is performed.

* * * * *